US008641360B2

(12) United States Patent
Noack

(10) Patent No.: US 8,641,360 B2
(45) Date of Patent: Feb. 4, 2014

(54) METHOD FOR BRAKING A ROTOR OF A TURBINE ENGINE AND A TURNING GEAR FOR DRIVING THE ROTOR OF A TURBINE ENGINE

(75) Inventor: Antje Noack, Duisburg (DE)

(73) Assignee: Siemens Aktiengesellschaft, München (DE)

( * ) Notice: Subject to any disclaimer, the term of this patent is extended or adjusted under 35 U.S.C. 154(b) by 1817 days.

(21) Appl. No.: 10/568,338

(22) PCT Filed: Jul. 16, 2004

(86) PCT No.: PCT/EP2004/007945

§ 371 (c)(1),
(2), (4) Date: Aug. 6, 2010

(87) PCT Pub. No.: WO2005/019603

PCT Pub. Date: Mar. 3, 2005

(65) Prior Publication Data

US 2011/0027061 A1 Feb. 3, 2011

(30) Foreign Application Priority Data

Aug. 13, 2003 (EP) ..... 03018376

(51) Int. Cl.
*F01D 21/00* (2006.01)

(52) U.S. Cl.
USPC ..... 415/1; 415/123

(58) Field of Classification Search
USPC ..... 415/1, 123, 122.1; 60/337
See application file for complete search history.

(56) References Cited

U.S. PATENT DOCUMENTS

| | | | | |
|---|---|---|---|---|
| 3,203,177 | A | 8/1965 | Johnson | |
| 3,655,293 | A * | 4/1972 | Williams | 415/17 |
| 4,854,120 | A | 8/1989 | Nelson et al. | |
| 2006/0137927 | A1* | 6/2006 | Fleming | 180/165 |
| 2010/0050703 | A1* | 3/2010 | Maekawa et al. | 68/23 R |
| 2010/0167863 | A1* | 7/2010 | Lemmers, Jr. | 475/150 |

FOREIGN PATENT DOCUMENTS

| | | |
|---|---|---|
| DE | 431 934 | 7/1926 |
| DE | 524 329 | 5/1931 |
| JP | 2010130764 A * | 6/2010 |

* cited by examiner

*Primary Examiner* — Richard Edgar

(57) ABSTRACT

The invention relates to a method for braking a rotor of a turbine engine, comprising a turning gear, with a drive supplied from an energy source, having an input shaft to which the rotor may be coupled, whereby, during a cooling phase for the turbine, the rotor may be driven by the drive using the coupled input shaft. According to the invention, a method for braking a rotor of a turbine engine can be achieved, in which the rotation of a rotor, caused by the airflow through the turbine, is slowed until the rotor stops, whereby after the end of the cooling phase, the drive drives the rotor in the reverse sense by means of the input shaft in order to brake the same.

15 Claims, 2 Drawing Sheets

METHOD FOR BRAKING A ROTOR OF A TURBINE ENGINE AND A TURNING GEAR FOR DRIVING THE ROTOR OF A TURBINE ENGINE

CROSS REFERENCE TO RELATED APPLICATIONS

This application is the US National Stage of International Application No. PCT/EP2004/007945, filed Jul. 16, 2004 and claims the benefit thereof. The International Application claims the benefits of European Patent application No. 0301837.8 EP filed Aug. 13, 2003, all of the applications are incorporated by reference herein in their entirety.

FIELD OF THE INVENTION

The invention relates to a method for braking a rotor of a turbine engine according to the claims and to a turning gear for driving a rotor of a turbine engine according to the claims.

BACKGROUND OF THE INVENTION

DE 524 329 discloses a device for the slow rotation of a steam turbine shaft. The exciting machine of the current generator coupled to the steam turbine shaft is operated as a motor in operational intermissions, in order to drive the turbine shaft. Since operating the generator as a motor requires higher rotational speeds than is necessary for rotary operation in the operational intermissions, a speed reduction gear is inserted between the rotor shaft and the drive shaft of the exciting machine.

It is known, furthermore, that, in a rundown program after the shutdown of a gas turbine, the rotor mounted in an oil bearing is rotated at a lower rotational speed in rotary operation, as it is known, by means of a turning gear. The components, heated and expanded through the operation of the turbine, are thus cooled, during this cooling phase, from the operating temperature of the gas turbine to the ambient temperature. The compressor sucks in ambient air and pumps this into the annular flow path for the combustion chamber and turbine, so that the components are cooled and heat is extracted from the gas turbine.

The oil bearing is in this case fed not only from a lubricating oil supply, but additionally from a boosting oil supply which serves for boosting the rotor hydrostatically during rotary operation.

After the turning gear has been switched off, an air draft through the compressor, the combustion chamber and the turbine may occur, which is designated as natural draft and depends on the weather situation. This air draft may become so large that, during the rundown program, the rotor of the gas turbine continues to remain in rotational movement, despite the turning gear being switched off.

The disadvantage of this is that the control of the gas turbine carrying out the rundown program does not then automatically switch off the oil supply of the oil bearing on account of the continual rotational movement of the rotor. The automated switch off of the oil supply of the oil bearing would take place only when the sensor arrangement monitoring the rotational speed detects the standstill of the rotor. This results in fault warnings from the controls which then require manual action. To brake the rotor, it is then necessary to switch off the oil supply manually, the rotor then rotating, unlubricated in the oil bearing, until it comes to a standstill. This may lead to wear and defects on the rotor and oil bearing.

SUMMARY OF THE INVENTION

The object of the invention is, therefore, to specify a cost-effective method for braking a rotor of a turbine engine, by means of which the rotational movement of the rotor caused by the air draft is slowed until the rotor stops. Furthermore, the object of the invention is to specify a gear corresponding to this.

The object relating to the method is achieved by means of the features of claim 1 and the object directed at the gear is achieved by means of the features of claim 6. Advantageous embodiments are specified in the subclaims.

The solution proceeds in this case from the consideration that, after the conclusion of the cooling phase, to brake the rotor, the latter drives the drive in reverse operation by means of the coupled drive shaft. The turning gear, already conceived and designed for the rotary operation of the rotor, is thus operated cost-effectively in reverse operation. Existing turbines which already have a turning gear can be converted cost-effectively by means of minor additions or modifications.

During the rundown program, the control automatically carries out braking operation after rotary operation and then, after the standstill of the rotor is detected, can switch off the oil supply to the oil bearing. Manual action on the rundown program can thus be prevented.

In a first advantageous embodiment, after the conclusion of the cooling phase, the drive is separated from the energy source and is connected to a load element. The separation of the energy source terminates the drive of the rotor and therefore the rotary operation of the turbine. By the load element being connected to the drive, the reverse operation of the drive can be carried out. The air draft prevailing in the turbine maintains the rotational movement of the rotor. The latter transfers the rotational movement to the drive via the drive shaft. The rotational energy is converted by the drive and is then dissipated by means of a load element. The load moment for the rotor rises, with the result that the rotational movement of the rotor slows, until the latter comes to a standstill.

Advantageously, the drive is designed as a hydraulic motor which in reverse operation works as a hydraulic pump.

Expediently, the drive is designed as an electric motor which in reverse operation works as an electrical generator.

When the rotor is mounted by means of an oil bearing, the energy supply to the oil bearing can be switched off after the standstill of the rotor.

When the drive is designed as a hydraulic motor which in reverse operation works as a hydraulic pump and a throttle or a valve is provided as a load element, the liquid medium conveyed by the hydraulic motor in reverse operation can flow through a throttle or a valve. Thus, in the circuit for the medium, a load element is provided, at which the flow energy of the conveyed medium is dissipated. The hydraulic motor is in this case driven by the air draft which flows through the flow path of the turbine and which at the same time sets the rotor in rotational movement. In this case, in an advantageous development, the throttle or the valve are designed to be regulatable, so that the required load moment can be set at any time in order to brake the rotor.

In an advantageous embodiment, the load element is designed as an electrical consumer and the drive as an electric motor. The rotational energy of the rotor is converted into an electrical current by means of the electric motor, which in this case, in reverse operation, works as an electrical generator, and is transferred to the consumer. The load of the consumer is in this case dimensioned such that a deceleration in the rotation of the rotor commences until the latter has come to a standstill. It is advantageous, in this case, that the load element is regulatable.

In an advantageous development, the turbine engine is designed as a gas turbine.

According to an advantageous proposal, the turbine engine is designed as a compressor.

BRIEF DESCRIPTION OF THE DRAWINGS

The invention is explained with reference to drawings in which.

DETAILED DESCRIPTION OF THE INVENTION

Figure 1:
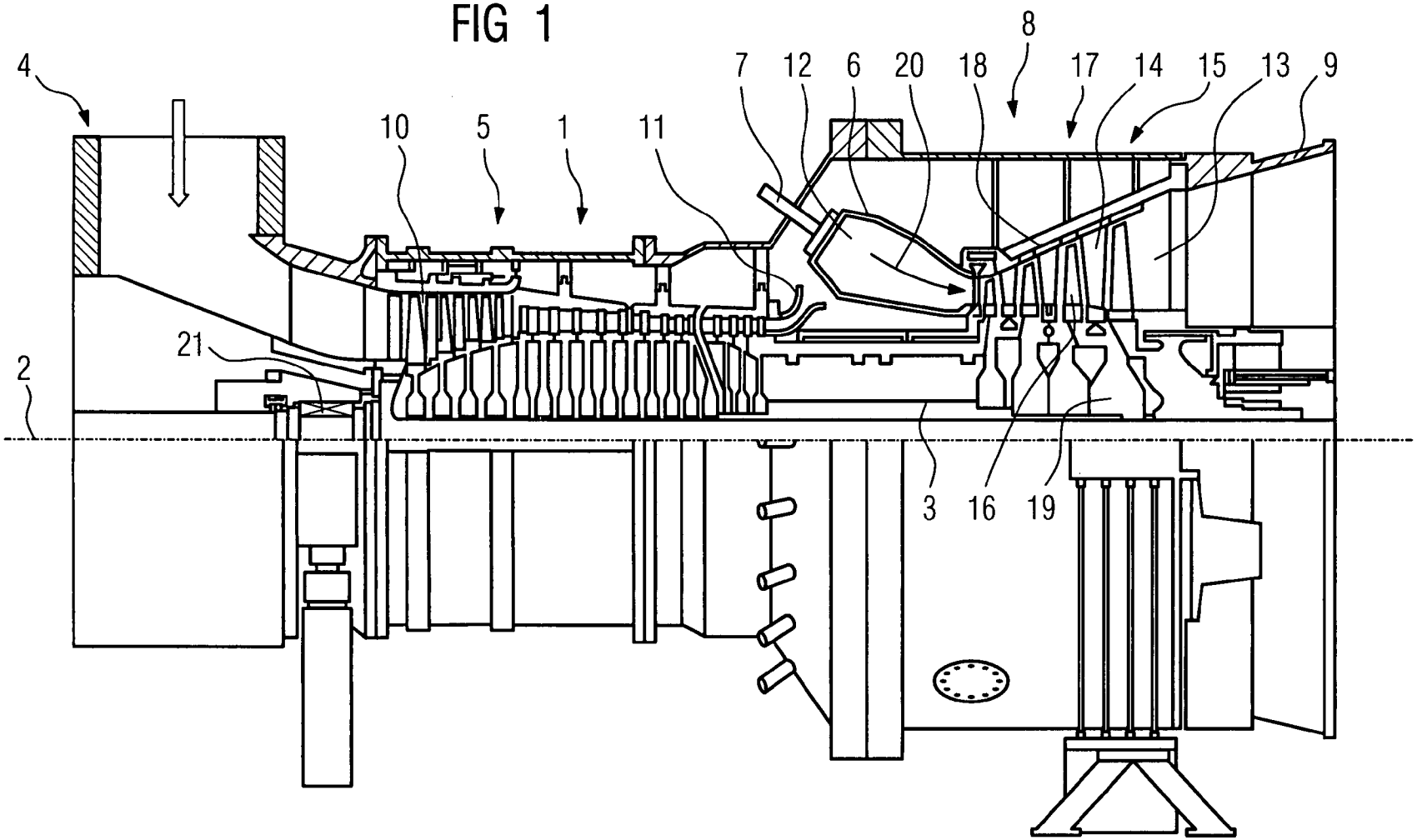
FIG. 1 shows a longitudinal part section through a gas turbine.

FIG. 1 shows a gas turbine 1 in a longitudinal part section. It has, inside, a rotor 3 which is rotary-mounted about an axis of rotation 2 and which is also designated as a turbine rotor or rotor shaft. An intake casing 4, a compressor 5, a toroidal annular combustion chamber 6 having a plurality of coaxially arranged burners 7, a turbine 8 and the exhaust gas casing 9 succeed one another along the rotor 3.

In the compressor 5, an annular compressor duct 10 is provided, which narrows in cross section in the direction of the annular combustion chamber 6. At the outlet, on the combustion chamber side, on the compressor 5, a diffuser 11 is arranged, which is flow-connected to the annular combustion chamber 6. The annular combustion chamber 6 forms a combustion space 12 for a mixture consisting of a fuel and of compressed air. A hot-gas duct 13 is flow-connected to the combustion space 12, the hot-gas duct 13 being followed by the exhaust gas casing 9.

Blade rings are in each case arranged alternately in the compressor duct 10 and in the hot-gas duct 13. A guide blade ring 15 formed from guide blades 14 is followed in each case by a moving blade ring 17 formed from moving blades 16. The fixed guide blades 14 are in this case connected to the stator 18, whereas the moving blades 16 are fastened to the rotor 3 by means of a turbine disk 19.

The rotor 3 is rotary-mounted by means of an oil bearing 21. The oil bearing 21 is in this case fed not only from a lubricating oil supply, but additionally from a boosting oil supply which serves for boosting the rotor 3 hydrostatically during rotary operation.

When the gas turbine 1 is in operation, air is sucked in through the intake casing 4 by the compressor 5 and is compressed in the compressor duct 10. The air provided at that end of the compressor 5 which is on the burner side is led through the diffuser 11 to the burner 7 and is mixed there with a fuel. The mixture is then burnt in the combustion space 10 so as to form a working fluid 20. The working fluid 20 flows from there into the hot-gas duct 13. The working fluid 20 expands at the guide blades 16 arranged in the turbine 8 and at the moving blades 18 so as to transmit pulses, so that the rotor 3 is driven and, together with the latter, a working machine (not illustrated) coupled to it.

Figure 2:
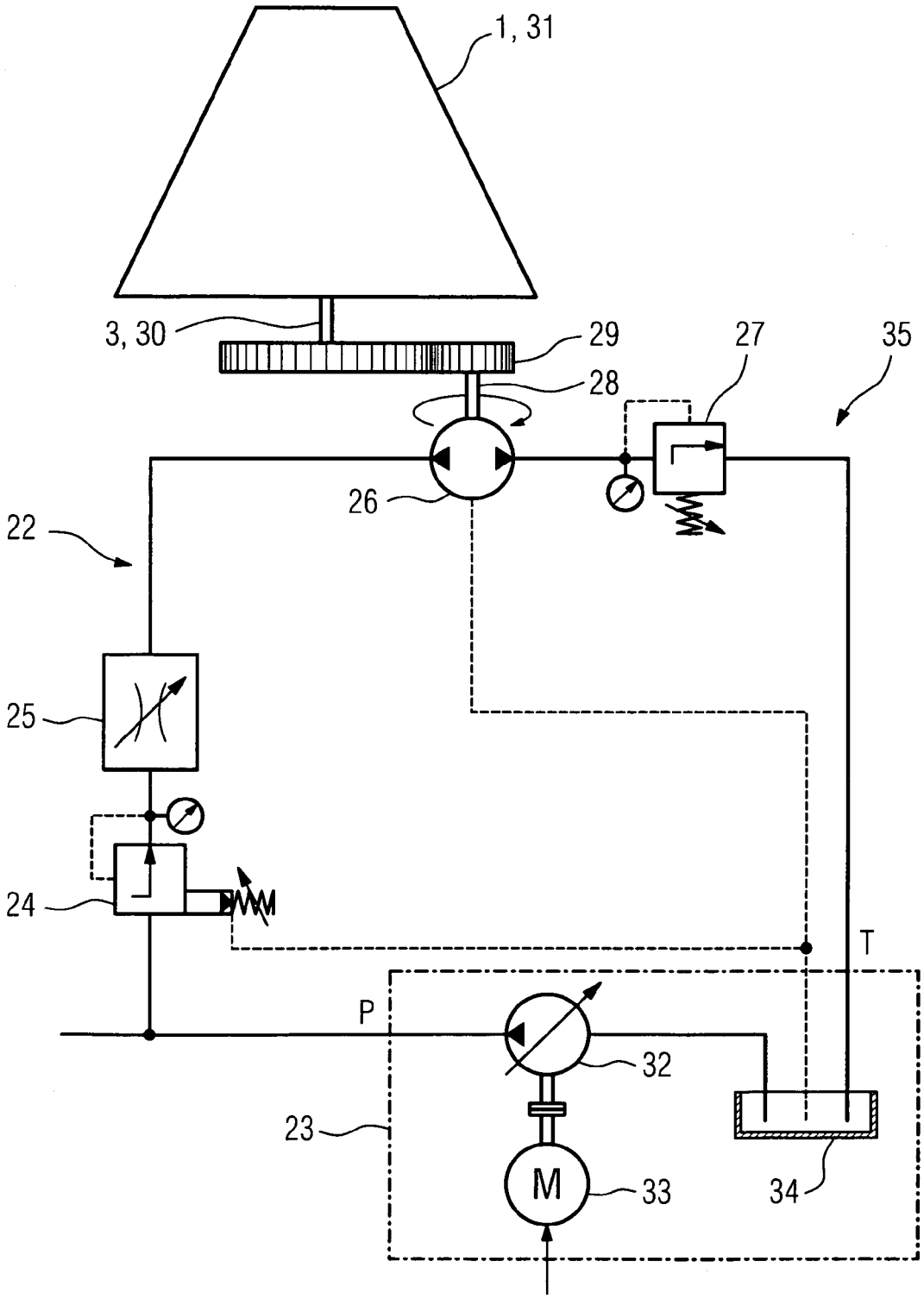
FIG. 2 shows a diagrammatic illustration of a turbine engine with a turning gear.

FIG. 2 shows a hydraulic circuit diagram 35 of a turning gear 22. An outlet P of the hydraulic assembly 23 is connected to the inlet of a pressure reduction valve 24. The outlet of the pressure reduction valve 24 is flow-connected to the inlet of a flow regulation valve 25, the outlet of which is connected to the inlet of a hydraulic motor 26. The outlet of the hydraulic motor 26 is connected to the inlet of a pressure limitation valve 27. The outlet of the pressure limitation valve 27 is flow-connected to the inlet T of the hydraulic assembly 23. A drive shaft 28 of the hydraulic motor 26 is connected via a gear 29 to a rotor 30 of a turbine engine 31.

The pressure reduction valve 24 and the pressure limitation valve 27 are actuated in each case electromagnetically.

The turbine engine 31 may in this case be designed as a compressor or else as a gas turbine 1.

The hydraulic assembly 23 has a regulatable hydraulic pump 32 which is driven by a motor 33. The inlet of the hydraulic pump 32 is in this case flow-connected to a hydraulic accumulator 34. The outlet of the hydraulic pump 32 is designed as the outlet of the hydraulic assembly 23.

The hydraulic circuit 35 is designed for three operating states: rotary operation, freewheel operation and braking operation.

When the turbine engine 31 is in operation, the drive shaft 28 of the hydraulic motor 26 is not coupled to the rotor 30 of the turbine engine 31. Only when the turbine engine 31 is shut down is the drive shaft 28 coupled to the rotor 30.

In a rundown program, the control of the turbine engine 31 starts rotary operation in order to cool the latter. For this purpose, the hydraulic motor 26 works as a drive motor which, by means of its drive shaft 28, drives the rotor 30 of the turbine engine 31 via a gear 29 at a low rotor rotational speed of $n=100\ min^{-1}$. For this purpose, the hydraulic motor 26 is fed from the hydraulic assembly 23, the pressure reduction valve 24 allowing a pressure of approximately 150 bar in the hydraulic medium. For volume setting, the flow regulation valve 25 limits the throughflow of the hydraulic medium to a volume of max. 70 l/min. The pressure limitation valve 27 is in this case not actuated, so that there is no pressure drop there. In rotary operation, as a result of the rotation of the rotor 30, air is pumped through the compressor duct 10, the annular combustion chamber 6 and the hot-gas duct 13 by the moving blades 16, so that the turbine engine 31 transfers the stored heat to the air more quickly. After the lowering of the temperature of the gas turbine 1 to below a predetermined limit value, rotary operation is set.

During subsequent freewheel operation, the drive shaft 28 remains connected to the rotor 30 via the gear 29. The pressure reduction valve lowers the pressure of the hydraulic medium to 10 bar. The hydraulic motor 26 thus continues to be supplied with a sufficient quantity of hydraulic media, without an effective drive torque in this case being generated on the drive shaft 28. The hydraulic motor 26 is thus decoupled from the hydraulic assembly 23 as energy source. The pressure limitation valve 27 remains set at 0 bar, so that there is no pressure loss in the hydraulic medium. The rotor rotational speed decreases on account of losses due to friction.

When, because of an air stream, designated as natural draft, which flows through the compressor duct 10, the combustion space 12 and the hot-gas duct 13, the rotor shaft is maintained at a rotational speed or the rotor rotational speed is prevented from falling below a predetermined limit rotational speed of $n=10\ min^{-1}$, the control of the turbine engine automatically switches from freewheel operation to braking operation.

In braking operation, the drive shaft 28 of the hydraulic motor 26 is coupled to the rotor 30 of the turbine engine 31. The pressure reduction valve 24 reduces the pressure in the hydraulic medium to 10 bar. The pressure limitation valve 27 is then activated in such a way that a pressure building up continuously is established there in the hydraulic medium. The pressure limitation valve 27 thus serves, in braking operation, as a load element for the hydraulic motor 26 operated in reverse operation. The hydraulic motor 26 is then driven by the rotation of the rotor 30, so that the latter works as a pump. The hydraulic motor 26 consequently conveys the hydraulic medium further on to the pressure limitation valve 24 where a build-up of pressure in the hydraulic medium takes place. A load for the rotating rotor 30 is thereby generated and brakes and slows the rotation. Owing to the closing of the pressure limitation valve 27, the desired braking torque is generated in order to bring the rotor 30 to a standstill.

After the limit rotational speed is undershot, the control of the turbine engine 31 automatically switches off the supply of the oil bearing 21 of the rotor 3 in order to conclude the rundown program. By the oil supply being prevented, friction is generated in the oil bearing 21 and brakes the rotor 30 to a standstill. This likewise prevents the rotor 30 of the turbine engine 31 from being set in rotational movement from standstill due to the natural draft.

After the oil bearing 21 has been switched off, the pressure limitation valve 24 can likewise be opened again, in order to relieve the hydraulic motor 26 and lower the pressure in the hydraulic medium.

Despite the internal leakage of the hydraulic motors 26, the stopping of the rotor 30 is possible.

To stop the rotors 3, 30 rapidly, freewheel operation may also be skipped, so that rotary operation is followed directly by braking operation.

Where a stationary gas turbine is concerned, the working machine may also be used as a brake, a load element being connected instead of a payload. Thus, for example, the generator could be short-circuited as a working machine, the internal resistance of the generator then serving as a load element.

The invention claimed is:

1. A method for braking a rotor of a turbine engine having a turning gear, comprising:

powering a drive motor from an energy source;

coupling the rotor to a drive shaft;

driving the rotor by the drive motor during a cooling phase of the turbine engine;

separating the drive motor from the energy source and connecting the dive motor to a load element after the cooling phase; and driving the drive motor by the rotor via the coupled drive shaft; and dissipating a rotational energy converted by the drive motor via the load element for braking the rotor to a standstill.

2. The method as claimed in claim 1, wherein after the cooling phase, the drive motor is electrically separated from the energy source and is electrically connected to a load element.

3. The method as claimed in claim 1, wherein the drive motor is a hydraulic motor which works as a hydraulic pump when connected to the load element.

4. The method as claimed in claim 1, wherein the drive motor is an electric motor which works as an electrical generator when connected to the load element.

5. The method as claimed in claim 1, wherein the rotor is mounted by an oil bearing, and after the standstill of the rotor, an energy supply of the oil bearing is switched off.

6. The method as claimed in claim 5, wherein after the standstill of the rotor, the energy supply of the oil bearing is automatically switched off.

7. A turning gear for driving a rotor of a turbine engine, comprising:

a drive motor that is powered from an energy source; and a drive shaft to which the rotor is coupled, wherein during a cooling phase of the turbine engine, the rotor is driven by the drive motor by the coupled drive shaft, wherein after the cooling phrase, the drive motor is separated from the energy source and is connected to a load element, the load element dissipates a rotational energy converted by the drive motor for braking the rotor to a standstill.

8. The gear as claimed in claim 7, wherein the load element is a regulatable load element.

9. The gear as claimed in claim 7, wherein the drive motor is a hydraulic motor which works as a hydraulic pump when connected to the load element.

10. The gear as claimed in claim 9, wherein the load element is a throttle or a valve.

11. The gear as claimed in claim 7, wherein the drive motor is an electric motor which works as an electric generator when connected to the load element.

12. The gear as claimed in claim 11, wherein the load element is an electric consumer.

13. The gear as claimed in claim 7, wherein the turbine engine is a gas turbine.

14. The gear as claimed in claim 7, wherein the rotor is mounted by an oil bearing, and after the standstill of the rotor, an energy supply of the oil bearing is switched off.

15. The gear as claimed in claim 14, wherein after the standstill of the rotor, the energy supply of the oil bearing is automatically switched off.

* * * * *